US009605371B2

(12) United States Patent
Colucci

(10) Patent No.: US 9,605,371 B2
(45) Date of Patent: Mar. 28, 2017

(54) DEVICE FOR LOCKING AND UNLOCKING THE DOOR OF AN ELECTRIC HOUSEHOLD APPLIANCE

(75) Inventor: Stefano Colucci, Sora (IT)

(73) Assignee: BITRON S.P.A., Turin (IT)

( * ) Notice: Subject to any disclaimer, the term of this patent is extended or adjusted under 35 U.S.C. 154(b) by 437 days.

(21) Appl. No.: 14/129,045

(22) PCT Filed: Jun. 28, 2012

(86) PCT No.: PCT/IB2012/053301

§ 371 (c)(1),
(2), (4) Date: Dec. 23, 2013

(87) PCT Pub. No.: WO2013/001493

PCT Pub. Date: Jan. 3, 2013

(65) Prior Publication Data

US 2014/0132013 A1 May 15, 2014

(30) Foreign Application Priority Data

Jun. 29, 2011 (IT) ..... TO2011A0569

(51) Int. Cl.

| | |
|---|---|
| ***E05B 15/02*** | (2006.01) |
| ***D06F 37/42*** | (2006.01) |
| ***D06F 39/14*** | (2006.01) |
| *E05C 1/06* | (2006.01) |

(52) U.S. Cl.

CPC ..... *D06F 37/42* (2013.01); *D06F 39/14* (2013.01); *Y10S 292/69* (2013.01); *Y10T 292/699* (2015.04)

(58) Field of Classification Search

CPC ..... Y10S 292/69
USPC ..... 292/144, 145, 150, 341.15, 341.16
See application file for complete search history.

(56) References Cited

U.S. PATENT DOCUMENTS

| | | | | | |
|---|---|---|---|---|---|
| 3,617,957 | A | * | 11/1971 | Brighenti | D06F 37/42 200/61.64 |
| 4,032,180 | A | * | 6/1977 | Pohl | D06F 37/42 200/61.64 |
| 4,365,830 | A | * | 12/1982 | Paulson | D06F 37/42 292/89 |
| 4,620,735 | A | * | 11/1986 | Heydner | D06F 37/42 200/50.1 |

(Continued)

FOREIGN PATENT DOCUMENTS

| | | |
|---|---|---|
| EP | 1 340 870 A1 | 9/2003 |
| EP | 2 105 527 A1 | 9/2009 |

(Continued)

*Primary Examiner* — Carlos Lugo
(74) *Attorney, Agent, or Firm* — Sughrue Mion, PLLC

(57) ABSTRACT

A device for locking and unlocking the door of an electric household appliance. The device includes an electrically controlled actuator (25, 26), which can be coupled to a movable control member (20) through a movable transmission member (29), and which, as a consequence of successive activations, tends, through the transmission member (29), to make the control member (20) alternately assume a first position and a second position, in which the control member (20) retains and frees, respectively, the locking member (9), maintaining it in the disengaged position and allowing its passage into the engaged position, respectively.

3 Claims, 8 Drawing Sheets

(56) References Cited

U.S. PATENT DOCUMENTS

| | | | | | |
|---|---|---|---|---|---|
| 5,520,424 | A * | 5/1996 | Hapke | D06F 37/42 | 292/198 |
| 6,082,787 | A * | 7/2000 | Chioffi | D06F 37/42 | 292/128 |
| 6,145,898 | A * | 11/2000 | Onderka | D06F 37/42 | 292/198 |
| 6,334,637 | B1 | 1/2002 | Chioffi | | |
| 6,634,684 | B2 * | 10/2003 | Spiessl | D06F 37/42 | 134/57 DL |
| 7,647,797 | B1 * | 1/2010 | Viso Cabrera | E05B 47/0012 | 292/144 |
| 7,775,070 | B2 * | 8/2010 | Lim | D06F 37/42 | 68/12.26 |
| 8,006,521 | B2 * | 8/2011 | Rocchitelli | D06F 37/42 | 134/57 DL |
| 8,556,308 | B2 * | 10/2013 | Lavrencic | D06F 37/42 | 292/341.15 |
| 8,727,391 | B2 * | 5/2014 | Berginc | A47L 15/4259 | 292/144 |
| 2004/0104580 | A1 * | 6/2004 | Spiessl | D06F 37/42 | 292/84 |
| 2011/0309638 | A1 * | 12/2011 | Gaj | A47L 15/4259 | 292/138 |

FOREIGN PATENT DOCUMENTS

| | | | | | |
|---|---|---|---|---|---|
| EP | 2 278 058 | A1 | | 1/2011 | |
| IT | EP 0965677 | A1 | * | 12/1999 | D06F 37/42 |
| IT | EP 1467048 | A1 | * | 10/2004 | D06F 37/42 |

* cited by examiner

DEVICE FOR LOCKING AND UNLOCKING THE DOOR OF AN ELECTRIC HOUSEHOLD APPLIANCE

CROSS REFERENCE TO RELATED APPLICATIONS

This application is a National Stage of International Application No. PCT/IB2012/053301 filed Jun. 26, 2012, claiming priority based on Italian Patent Application No. TO2011A000569, filed Jun. 29, 2011, the contents of all of which are incorporated herein by reference in their entirety.

The present invention relates to a device for locking and unlocking the door of a household appliance such as a washing machine or a washer-drier.

U.S. Pat. No. 6,334,637 B1, held by the present applicant, discloses a door locking device of this type, comprising a support casing with an opening for the introduction of a hook member connected to the door, and with a retaining member which is movable with respect to the casing between a rest position, in which it allows the introduction of the hook member into said opening, and a working position, in which it can retain the hook member introduced into said opening. The device disclosed in this United States patent further comprises a locking member which is movable between a disengaged position and an engaged position, in which it can allow and prevent, respectively, the passage of the retaining member (slider) from the working position to the rest position, and electrically activatable control devices for controlling the position of this locking member.

These control devices comprise an electrically controlled actuator adapted, each time it is activated, to cause the rotation by a predetermined amount of a rotatable toothed wheel, which has a predetermined control profile of the cam type. This control profile is coupled to the locking member in such a way that, in at least a first and a second angular position, respectively, the control profile retains and frees, respectively, the locking member, thus preventing and allowing, respectively, its passage from the disengaged position to the engaged position.

In a locking and unlocking device of this type, there is a possibility that the aforesaid toothed wheel may be placed, for example as a result of the hysteresis of the contact which signals the closure of the door, in the aforesaid (second) angular position in which it allows the locking member to pass to the locking position while the door or hatch of the appliance is closed but is not locked, because the retaining member or slider is in a position in which it automatically prevents the locking member from moving outwards and passing to the locking position. If this occurs, and if the door is then put into the closed and lockable condition, the engaging member or slider is displaced, and the door is then locked in the closed position as a result of the preceding actuation of the aforesaid toothed wheel, without the need to send a further pulse to the coil-type electrical actuator which controls the position of this wheel. In these conditions, the door is locked in the closed position as a result of the "memory" of the preceding actuation of the toothed control wheel, and this may lead to hazardous situations.

EP 2 278 058 A1 discloses a device according to the introductory part of claim 1, in which the control means comprise a solenoid or coil with a core coupled to the locking member by means of a mechanical transmission. This transmission includes a bistable fastening and release mechanism, comprising a sliding cursor provided with a heart-shaped groove, an associated follower and a return spring. The sliding cursor of this mechanism is coupled to a first arm of a lever which has a second arm coupled to the movable locking member by means of a pair of driving teeth on this second arm and an interacting driven tooth on the locking member. The latter is also coupled to two metal strips acting as movable contacts of corresponding electrical switches. A first of these strips can stop the movement of the locking member when the door is open. This is because the retaining member or main slider of the device is coupled to an actuator which is controlled by a cam and which is positioned, when the door is open, so as to lock said first strip and thereby prevent the passage of the movable locking member into its engaged position.

In the prior art device considered here, no direct interaction takes place between the retaining member or main slider and the transmission member represented by the core of the solenoid, and furthermore the structure of the aforesaid transmission is highly complicated.

One object of the present invention is to provide a device for locking and unlocking the door or hatch of an electric household appliance which enables the aforementioned drawbacks of the prior art devices to be overcome.

This object is achieved according to the invention by means of a locking and unlocking device whose salient features are defined in the attached Claim 1.

Further characteristics and advantages of the invention will be made clear by the following detailed description, provided purely by way of non-limiting example, with reference to the appended drawings, in which.

Figure 1:
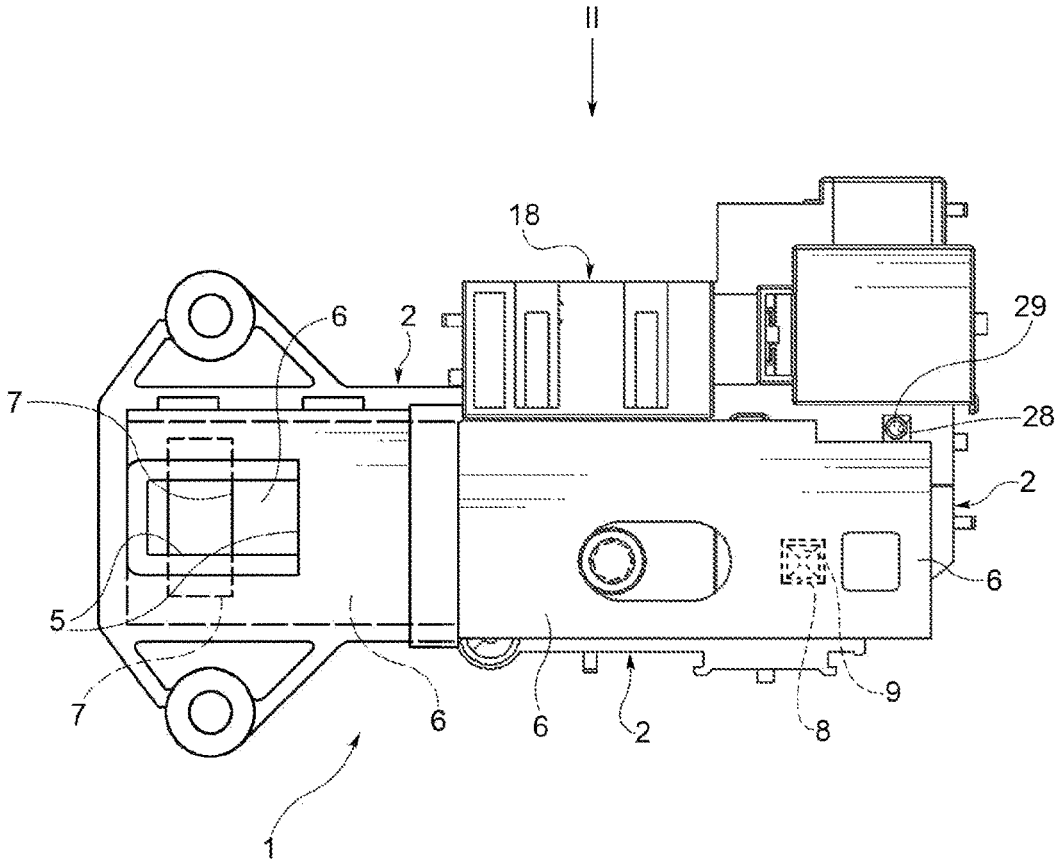
FIG. 1 is a front view of a device according to the invention.
Figure 2:
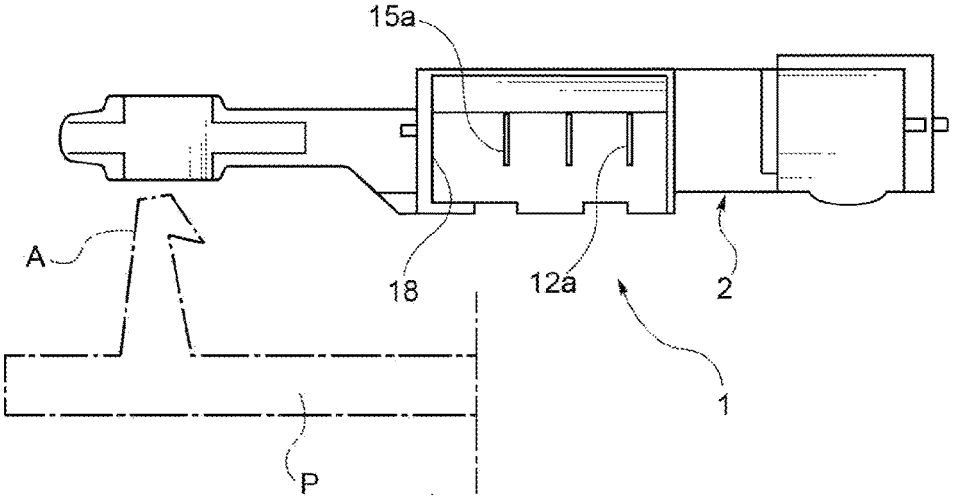
FIG. 2 is a side view of the device of FIG. 1.

In FIGS. 1 to 5, the number 1 indicates the whole of a locking and unlocking device according to the invention.

This device comprises a support casing 2, made of electrically insulating material, intended to be fastened to the structure of a household appliance, in the proximity of a loading or access opening which has an associated door P (FIG. 2) provided in a known way with a hook member A.

A retaining member or slider 6, provided with an opening or window 7 through which the hook member A can pass, is mounted slidably on the support casing 2 of the device 1.

When the door P is open (FIGS. 1-3), the retaining member 6 is kept (by an associated spring which is not shown) in a rest position in which the hook member A of the door P can be introduced through an opening in the casing 2 and the window 7 of the slider 6 when the door P is closed, and, conversely, can be disengaged from this window and from said opening when the door is opened.

As shown in FIG. 1, when the retaining member or slider 6 is in the rest position it covers an opening 8 formed in the supporting casing 2, in which a locking member 9 extends in a translatable way.

In a known way, the arrangement is such that, when the door P is closed, the hook member A engages in the opening or window 7 of the retaining member or slider 6, and causes the latter to be translated (towards the left as seen in FIG. 1) in such a way as to uncover the opening 8.

Figure 6:
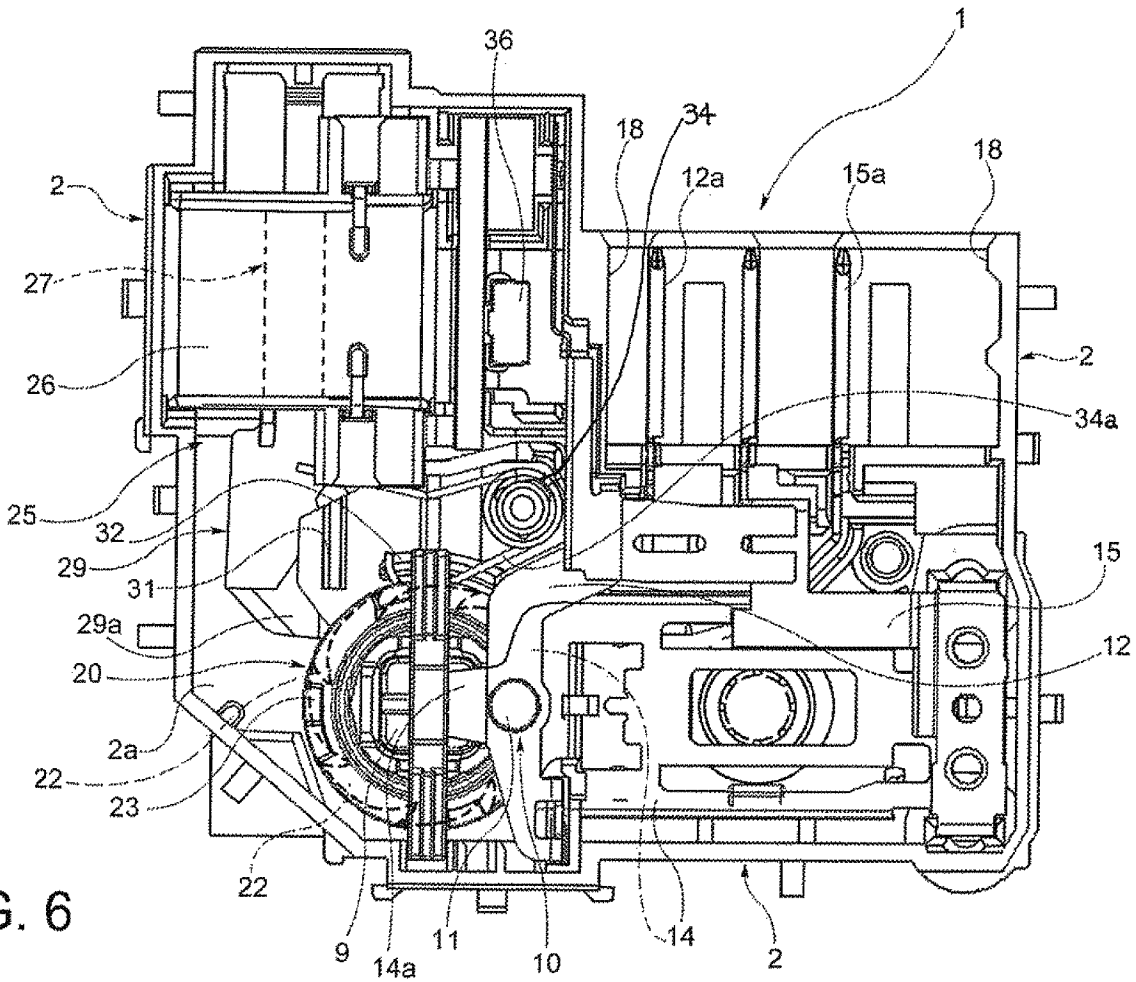
FIG. 6 is a plan view of part of the locking device taken along the line V-V in FIG. 5, shown in the door open condition.
Figure 7:
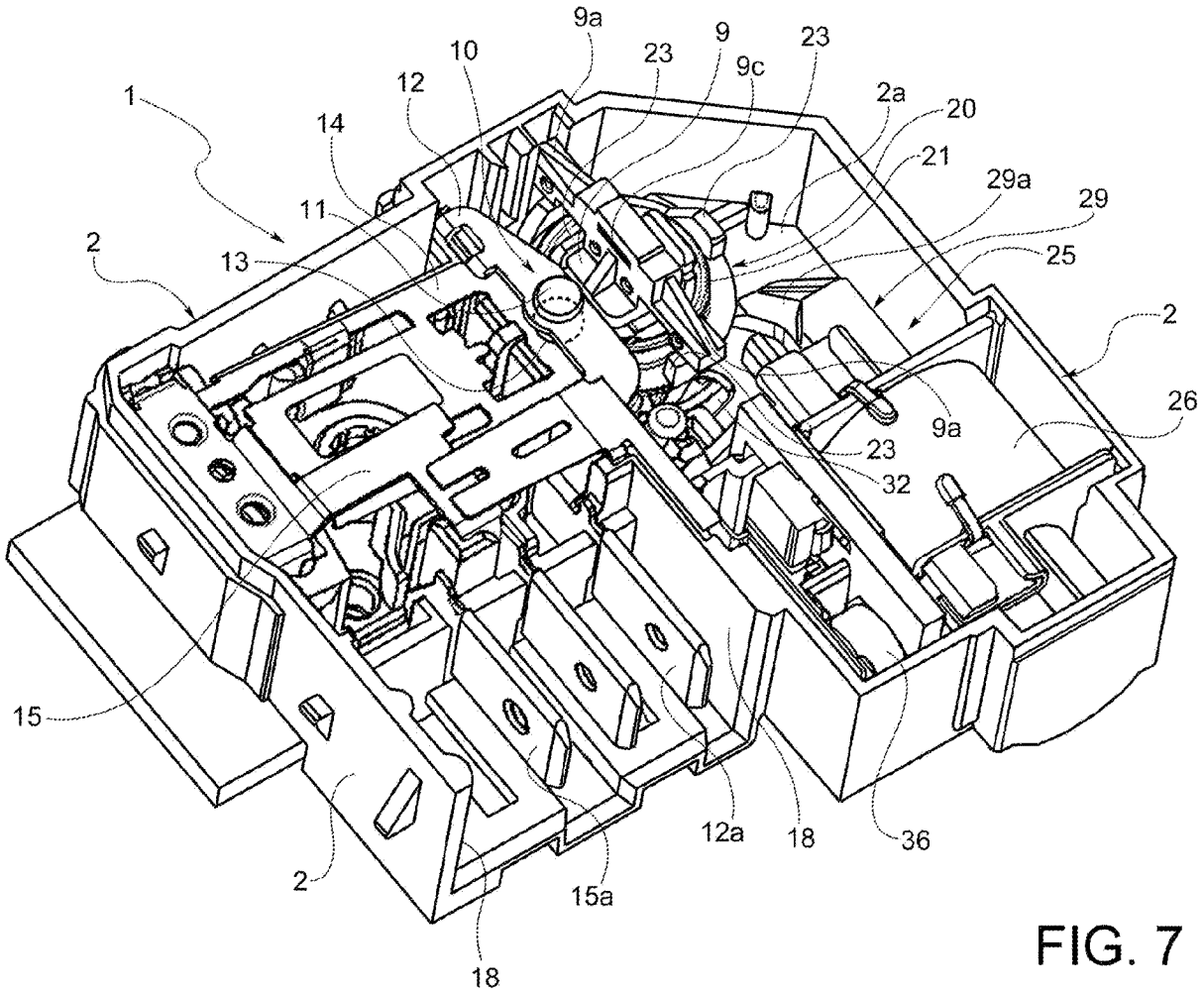
FIG. 7 is a perspective view of the part of the device shown in FIG. 6.

With reference to FIGS. 6 and 7, a switch indicated in a general way by 10 is positioned inside the casing 2. This switch comprises an opposing contact 11 carried by a shaped metal blade 12, of which one end 12*a* is shaped in the form of a flat pin which acts as a connecting terminal and extends into a recessed seat 18 of the support casing (FIGS. 6 and 7).

The switch 10 further comprises a moving contact 13 (FIG. 7) carried by the upper face of one end of a metal blade 14, the other end of which is connected to a shaped metal member 15 (FIGS. 6 and 7).

The end of the blade 14 which carries the moving contact 13 extends under the fixed contact 11, and forms a terminal tab 14*a* (shown in FIG. 6 only) which extends into a slot 9*c* (FIG. 7) in the locking member 9.

The blade 14 is made and mounted in such a way that it tends to push the corresponding contact 13 downwards, as seen in FIGS. 6 and 7, in other words away from the opposing contact 11, and also tends to push the locking member 9 downwards.

In a variant which is not shown, the blade 14 extends over the fixed contact 11, in such a way that it tends to push its own contact 12 towards the fixed contact 11.

Figure 9:
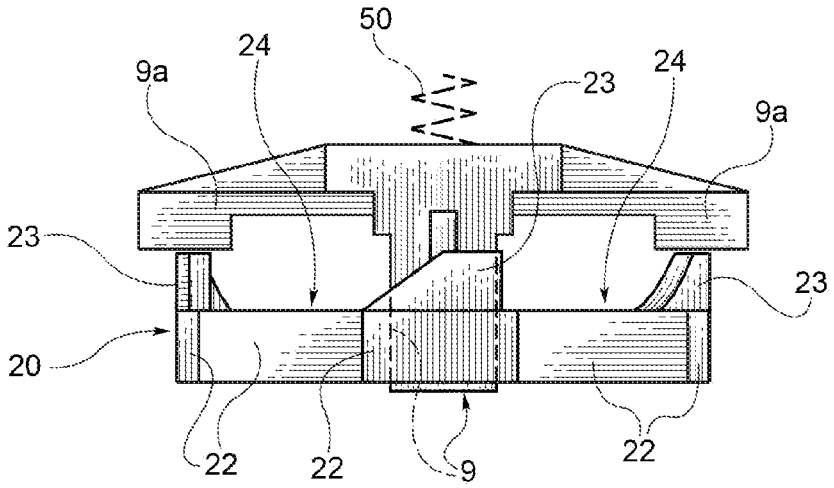
FIGS. 9 and 10 are partial side views showing part of the device according to the invention in two different operating conditions, namely the door open condition and the door closed and locked condition respectively.
Figure 10:
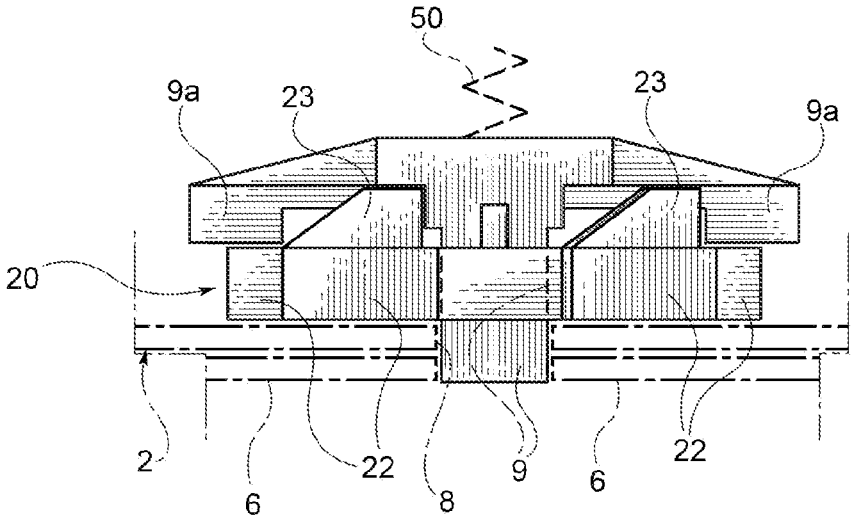

The locking member 9 is associated with a resilient opposing means such as the spring shown schematically and indicated by 50 in FIGS. 9 and 10, which tends to push this member 9 towards the outward locking position shown in FIG. 10. The resilient opposing means could be formed, additionally or alternatively, by the blade 14 which carries the moving contact 13, a continuation of which could extend until it engages the locking member 9.

The metal connecting member 15 forms an appendage or end 15*a* (FIGS. 6 and 7) shaped in the form of a flat pin, which extends into the seat 18 of the support casing 2 and acts as a connecting terminal.

As shown in FIG. 7 for example, in the embodiment illustrated by way of example, the locking member 9 has a pair of transverse appendages 9*a*. These appendages interact, as described more fully below, with a cam or toothed profile 23 of an annular toothed wheel 20 mounted rotatably in the support casing 2 about a stationary annular formation 21, which in turn extends around the locking member 9.

The toothed wheel 20 is conveniently made of plastic material. It can be made in one piece or, for simplicity of moulding, can be made in two parts which are bonded or otherwise fixed together.

The lower portion of the wheel 20 has toothing in the form of sawteeth 22 which are spaced at equal angular intervals, while the upper portion of this wheel has a plurality of cams or frontal teeth 23 which are spaced apart at equal angular intervals, being separated by intervals 24 (FIG. 9).

In a preferred embodiment, the teeth 23 have a profile in the form of a rectangular trapezium, with one side or flank inclined and the other side or flank at a right angle.

In the embodiment illustrated by way of example, the wheel 20 has eight lower sawteeth 22 and four upper cams or teeth 23. The pitch of the teeth 23 is equal to two adjacent sawteeth 22.

The arrangement is such that, when the radial appendages 9*a* of the locking member 9 extend on to the top of a pair of cams or teeth 23 of the wheel 20, the locking member 9 is urged into the raised disengaged position and held there, as shown in FIG. 9.

However, when the wheel 20, following an angular movement, presents to the radial appendages 9*a* of the locking member 9 respective intervals 24 between consecutive teeth or cams 23, the locking member 9 can pass into the outward engaged position, under the action of the associated resilient opposing member 14 and/or 50, as shown in FIG. 10.

Figure 8:
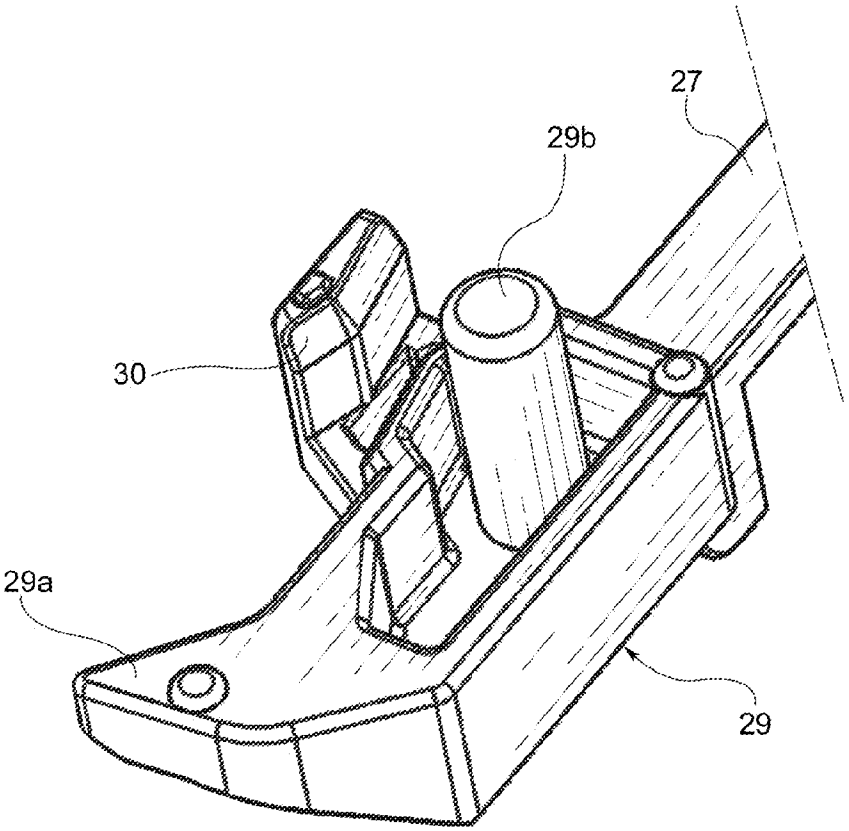
FIG. 8 is a perspective view of a hook forming part of the device according to the invention.

In FIGS. 6 and 7, the number 25 indicates the whole of an electrically operated actuator. In the embodiment illustrated by way of example, this actuator comprises a coil or solenoid 26 in which a core 27 is mounted in an axially translatable way (FIG. 6), one end of the core being connected to a shaped member indicated as a whole by 29, visible in FIGS. 6, 7 and 8. In its central part, this member has an appendage 30 (FIG. 8) which extends in a guide groove 31 (FIG. 6) formed in a wall 2*a* (FIGS. 6 and 7) of the support casing 2 of the device.

The end 29*a* of the member 29 which is opposite the actuator 25 is shaped in the form of a catch and is adapted to engage between a pair of consecutive sawteeth 22 of the toothed wheel 20 (see, in particular, FIG. 6).

The number 34 indicates a torsion spring having an arm 34*a* engaged between a pair of consecutive sawteeth 22 of the toothed wheel 20 (FIG. 6). The arm 34*a* of the spring 34 essentially acts as a pawl for fixing the angular position of the toothed wheel 20.

The arrangement described above is such that, whenever the actuator 25 is energized, the core 27 is translated (downwards as seen in FIG. 6) and causes a movement of the shaped member 29, which in turn causes a corresponding rotation of the toothed wheel 20 (in the anticlockwise direction as seen in FIG. 6). Having completed this angular movement, the pawl 32 again fixes the angular position of the wheel 20.

Figure 3:
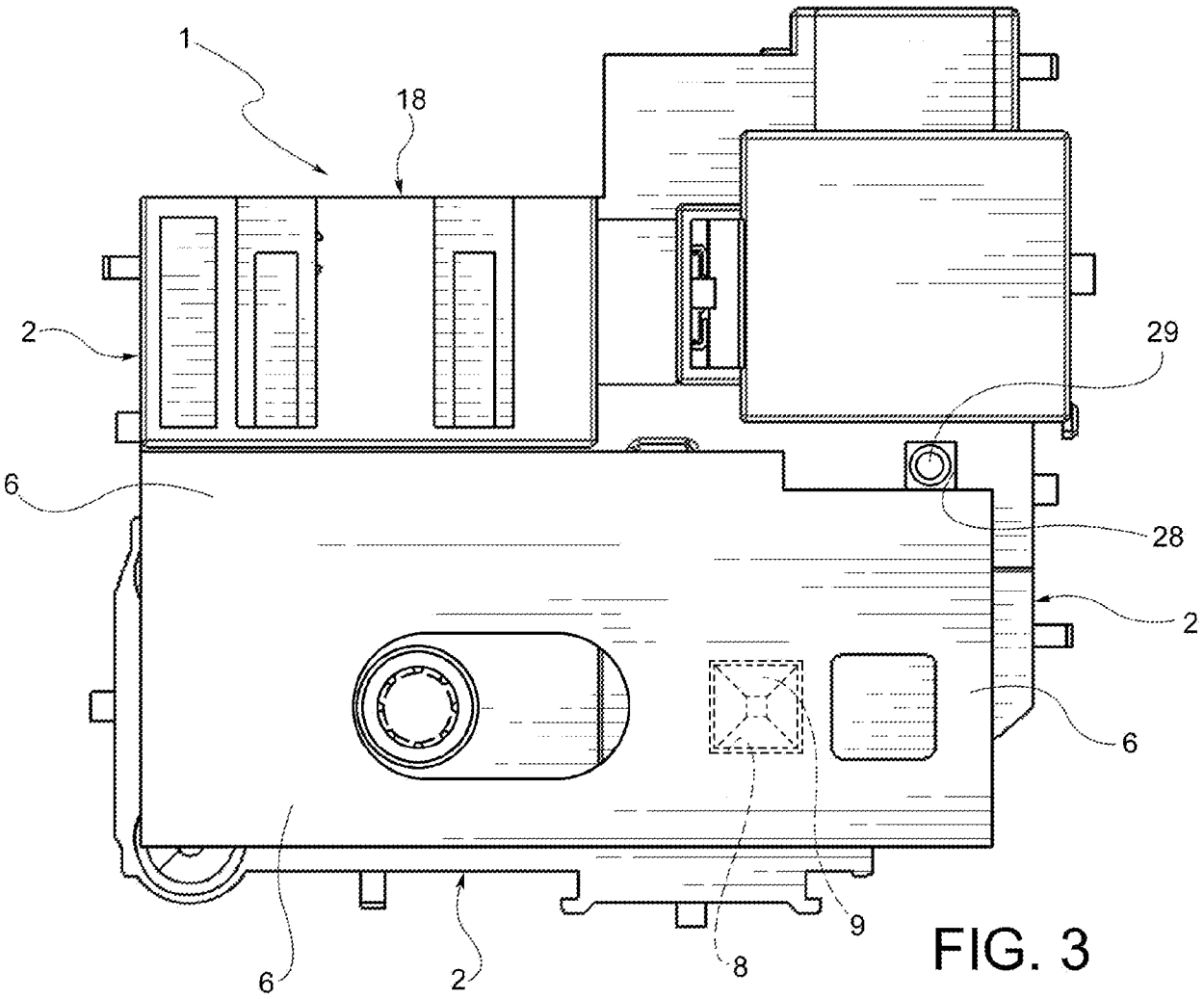
FIG. 3 is a partial plan view of the device of FIGS. 1 and 2, shown in the door open condition.
Figure 4:
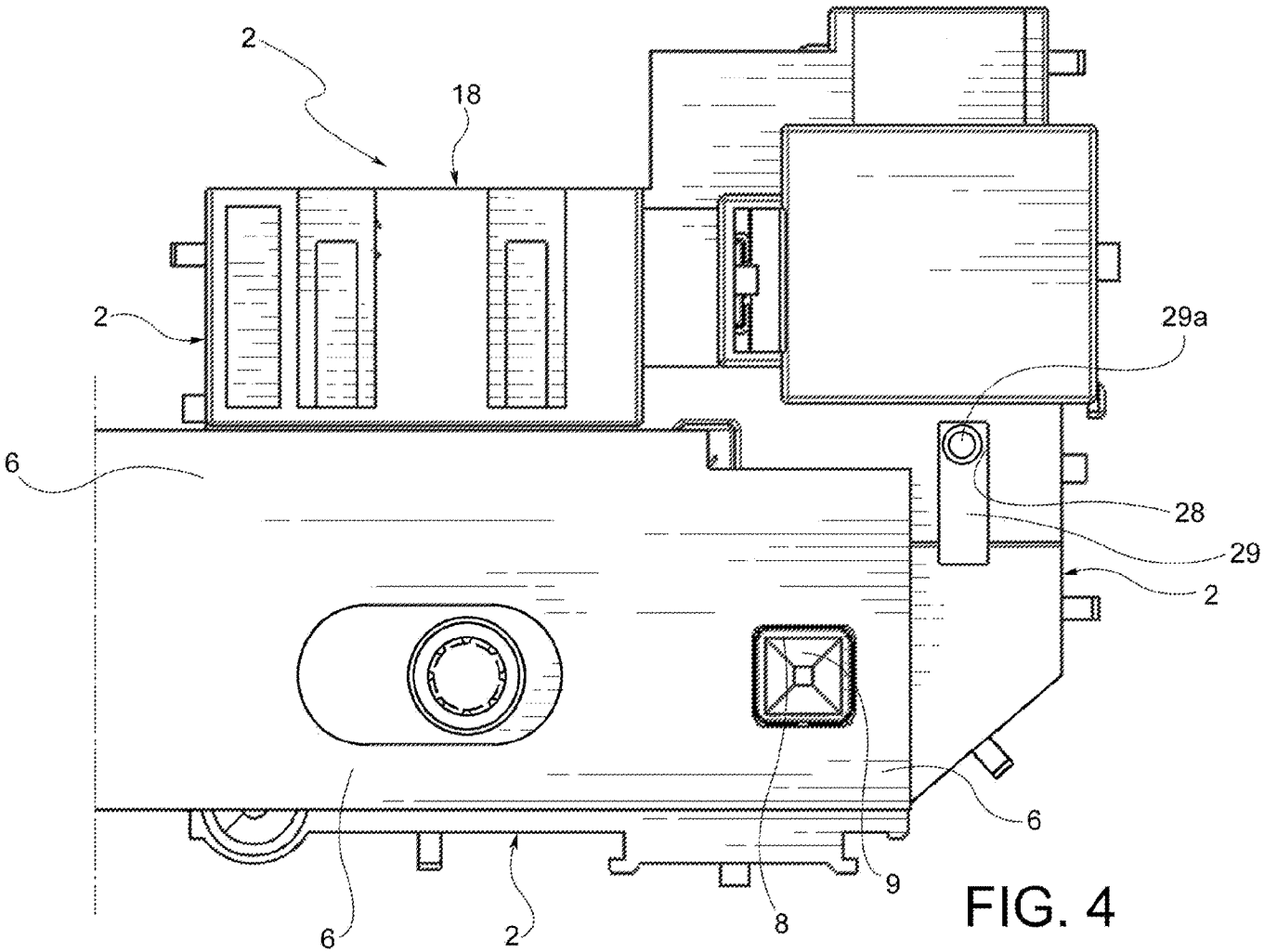
FIG. 4 is a partial plan view of the device of FIG. 3, shown in the door closed condition.
Figure 5:
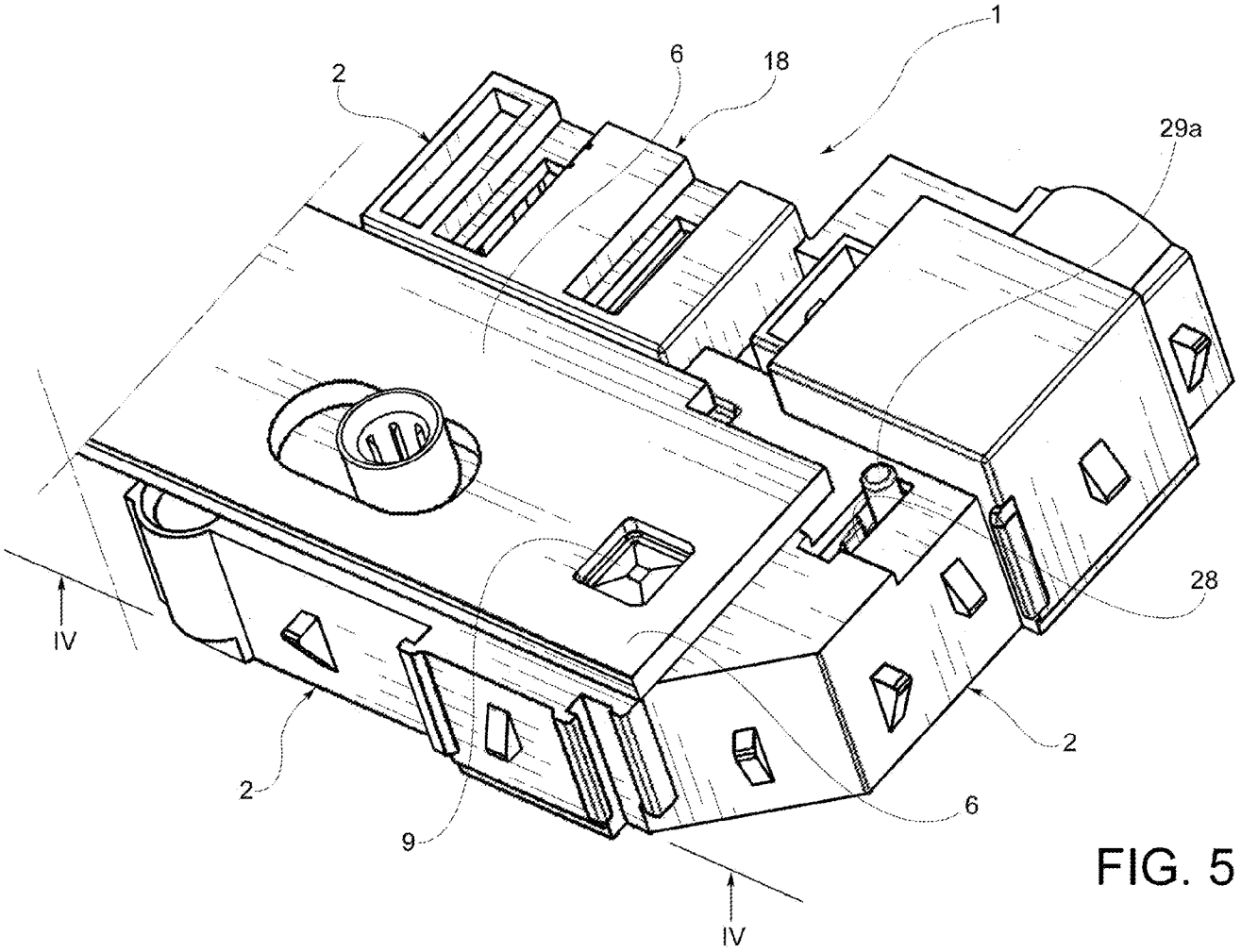
FIG. 5 is a partial perspective view of the device of FIGS. 3 and 4, shown in the door closed condition.

The member 29 also has a transverse formation 29*b* in the form of a pin, which extends through a penetrating opening 28 of elongate shape provided in the wall 2*a* of the casing 2 (FIG. 3). As shown in FIGS. 3-7, the opening 28 extends orthogonally to the direction of movement of the slider 6, and parallel to the direction of translation of the core 27. The arrangement is, in particular, such that the pin 29*b* can be freely translated in the opening 28 (thereby allowing the member 29 to engage with, and cause the rotation of, the toothed wheel 20) when the slider 6 is in the position of FIGS. 4 and 5, in which the door P is closed. Conversely, when the slider 6 is in the rest position of FIGS. 1-3, in which the door P is open, this slider 6 locks the pin 29*b* at one end of the opening 28, preventing the member 29 from causing the rotation of the toothed wheel 20.

In a known way, a positive temperature coefficient (PTC) resistor, indicated by 36 in FIGS. 6 and 7, is connected in series with the winding or coil 26 of the actuator 25. This resistor advantageously enables the current supplied to the coil 26 of the electromagnetic actuator 25 to be limited automatically whenever the duration of the supply of this current exceeds a predetermined period. By using the PTC resistor 36, therefore, it is possible to use an electromagnetic actuator 25 having a small and relatively economical coil 26.

The locking and unlocking device described above operates in the following manner.

When the door P is open, the locking and unlocking device is in the condition shown in FIGS. 1-3, 7 and 9: the locking member 9 is "covered" by the retaining member or slider 6 (FIGS. 1 and 3) and is kept in the retracted disengaged position as a result of the positioning of its transverse appendages 9*a* on a pair of teeth or cams 23 of the toothed wheel 20 (FIGS. 7 and 9). The locking member 9 keeps the blade 14 in the position in which its contact 13 engages the opposing contact 11. In this condition, the switch 10 is therefore closed.

When the door P is closed, as mentioned above, the slider 6 is translated and "uncovers" the locking member 9. In this stage, however, the locking member 9 is retained in the retracted position of disengagement from the toothed wheel 20, which remains in the same angular position as that assumed during the preceding stage.

When the user of the electric household appliance puts the appliance into operation, a control unit of the appliance causes the actuator 25 to be energized in a known way. As a result of this energizing, the member 29 causes a rotation of the toothed wheel 20. The wheel is then in the position shown in FIG. 10, in which the upper portion of the wheel presents to the appendages 9*a* of the locking member 9 corresponding intervals 24 between pairs of trapezoidal teeth or cams 23. The locking member 9 is therefore held in the outward engaged position (FIG. 10) by the associated resilient opposing member. In this condition, the blade 14 and the associated moving contact 13 move away from the opposing contact 11. The switch 10 is then open.

With the locking member 9 in the outward position, the return of the retaining member or slider 6 to the rest position, in which it allows the door P to be opened, is prevented.

On completion of the operating cycle of the electric household appliance, the control unit of the appliance causes two successive energizing pulses to be sent to the coil 26 of the electromagnetic actuator 25, in order to allow the door to be opened. Consequently, the toothed wheel 20 is made to rotate through a distance corresponding to the extension of two of its sawteeth 22. This rotation causes the radial appendages 9*a* of the locking member 9 to engage with corresponding trapezoidal teeth or cams 23 of the wheel. The locking member 9 is therefore returned to the retracted or disengaged position shown in FIG. 9, in which it again allows the retaining member or slider 6 to return to the position in which it allows the door P to be opened.

At the same time, the switch 10 is reclosed.

Because of the two energizing pulses required to allow unlocking, the operation of the device described above is particularly reliable and prevents the unlocking from being enabled as a result of any undesired energizing of the actuator 25, due for example to the reception of electromagnetic interference. Furthermore, the device can easily be modified in such a way that only one energizing pulse (or a different number of pulses) for the electromagnetic actuator 25 is required for unlocking.

With the device according to the invention described above, if, while the door P is open (and therefore while the slider 6 obstructs the opening 8 and prevents any outward movement of the locking member 9), the toothed wheel 20 is caused, by a control pulse sent to the coil 26, to move towards a position in which it would allow the passage of the locking member 9 to the outward position, the slider 6 interferes with and directly locks the pin 29*b* of the member 29, and prevents this rotation of the toothed wheel, thus locking the mechanism in its existing position.

After the end of the aforesaid pulse for causing the wheel 20 to rotate, the wheel 20 is placed, and remains, in its original position, and continues to hold the locking member 9 in the retracted condition (the disengaged position).

Therefore, when the door P is subsequently closed, a new control pulse must be applied to the solenoid 26 in order to actuate its locking.

Naturally, the principle of the invention remaining the same, the forms of embodiment and the details of construction may be varied widely with respect to those described and illustrated, which have been given purely by way of non-limiting example, without thereby departing from the scope of the invention as defined by the attached claims.

The invention claimed is:

1. A device for locking and unlocking a door (P) of an electric household appliance, wherein a hook member (A) is connected to the door (P) and can be inserted into an opening (5) of a retaining structure (2), the device (1) comprising:

a support casing (2) in which there is provided an electrical switch (10), the state of which is indicative of the open or closed condition of the door (P);

a retaining member or slider (6) mounted movably with respect to the casing (2) between a rest position in which it allows the introduction of the hook member (A) into said opening (5) and at least one working position in which it is adapted to retain the hook member (A) introduced into said opening (5);

locking means (9, 20), including:

a locking member (9) movable in the casing (2) relative to the retaining member or slider (6) between a disengaged position and an engaged position in which it is adapted to allow and prevent, respectively, the passage of the retaining member (6) from the working position to the rest position, opposing means (14, 50) associated with the locking member (9) and tending to maintain the locking member in the engaged position, and electrically activatable control means (20 to 34) adapted to control the position of said locking member (9);

said control means comprising:

an electrically controlled actuator (25, 26), which can be coupled to a movable control member (20) through a movable transmission member (29), and which, as a consequence of successive activations, tends, through the transmission member (29), to make said control member (20) alternately assume a first position and a second position, in which the control member (20) retains and frees, respectively, the locking member (9), maintaining it in the disengaged position and allowing its passage into the engaged position under the action of said opposing means (14, 50), respectively, wherein said transmission member (29) is configured and arranged in such a way that the transmission member interferes with and is locked by said retaining member or slider (6) when the retaining member or slider is in the rest position, thus impeding the passage of the control member (20) to said second position, the arrangement being such that, if the actuator (25, 26) is energized while the door (P) is open, the retaining member or slider (6) prevents the transmission member (29) from causing the control member (20) to pass from the first to the second position, and the control member, in turn, locks the locking member (9) in the disengaged position, in such a way that when the door (P) is next closed the door remains unlocked until the next activation of the actuator (25, 26).

2. The device according to claim 1, wherein the actuator (25, 26) is adapted, each time it is energized, to cause, through the transmission member (29) which is movable back and forth, a rotation by a predetermined amount of a toothed wheel (20) mounted rotatably in the casing (2) and having a predetermined control profile with cams or teeth (23) which is coupled to the locking member (9);

the arrangement being such that successive activations of the actuator (25, 26) tend to make the toothed wheel (20) assume at least one first and one second angular position, respectively, in which said control profile (23) retains and frees, respectively, the locking member (9), thus keeping the locking member in the disengaged position and allowing passage the into the engaged position, respectively.

3. The device according to claim 2, wherein the transmission member (29) has a catch-like formation (29*a*) adapted to interact with said toothed wheel (20) to cause successive angular displacements thereof; the transmission member (29) also having a pin-shaped formation (29*b*), which extends movably in a seat (28) of the casing (2) and which is configured to interact with the retaining member or slider (6) in such a way that said retaining member or slider (6) prevents the interaction between the transmission member (29) and the toothed wheel (20) when the door (P) is open.

* * * * *